US009728835B2

(12) United States Patent
Lam et al.

(10) Patent No.: US 9,728,835 B2
(45) Date of Patent: Aug. 8, 2017

(54) PLASMA-INTEGRATED SWITCHING DEVICES

(71) Applicant: The Boeing Company, Chicago, IL (US)

(72) Inventors: Tai A. Lam, Renton, WA (US); Julio Navarro, Kent, WA (US); Claudio G. Parazzoli, Seattle, WA (US); Benjamin E. Koltenbah, Federal Way, WA (US)

(73) Assignee: The Boeing Company, Chicago, IL (US)

( * ) Notice: Subject to any disclaimer, the term of this patent is extended or adjusted under 35 U.S.C. 154(b) by 97 days.

(21) Appl. No.: 14/549,230

(22) Filed: Nov. 20, 2014

(65) Prior Publication Data

US 2016/0149287 A1 May 26, 2016

(51) Int. Cl.

| | |
|---|---|
| ***H01Q 21/00*** | (2006.01) |
| ***H01Q 1/00*** | (2006.01) |
| ***H01H 9/04*** | (2006.01) |
| ***H01P 1/10*** | (2006.01) |
| ***H05H 1/52*** | (2006.01) |

(Continued)

(52) U.S. Cl.

CPC ..... *H01Q 1/002* (2013.01); *H01H 9/04* (2013.01); *H01P 1/10* (2013.01); *H01P 5/024* (2013.01); *H01Q 21/00* (2013.01); *H05H 1/52* (2013.01); *H01H 2223/002* (2013.01); *H01P 5/107* (2013.01); *H05H 2001/466* (2013.01)

(58) Field of Classification Search

CPC ..... H01Q 3/24; H01Q 21/28; H01Q 1/243; H01Q 9/0407

USPC ..... 343/893, 876, 904, 720

See application file for complete search history.

(56) References Cited

U.S. PATENT DOCUMENTS 5,329,205 A 7/1994 Goebel et al.
5,608,297 A 3/1997 Goebel (Continued)

FOREIGN PATENT DOCUMENTS

JP H07106314 A 4/1995

OTHER PUBLICATIONS

Extended European Search Report for EP Application No. 15191019.7-1812 from the European Patent Office dated Mar. 31, 2016.

(Continued)

*Primary Examiner* — Dameon E Levi
*Assistant Examiner* — Collin Dawkins
(74) *Attorney, Agent, or Firm* — Toler Law Group, PC

(57) ABSTRACT

A switching device includes a first electrode at least partially disposed within a sealed chamber. The sealed chamber encloses a plasma phase change material. The switching device includes a second electrode at least partially disposed within the sealed chamber. The second electrode is physically separated from the first electrode. When subjected to a signal that satisfies a threshold, the plasma phase change material forms a plasma within the sealed chamber. The first electrode is electrically coupled to the second electrode via the plasma when the plasma is formed. The first electrode is electrically isolated from the second electrode when the plasma is not formed. The switching device includes a first connector electrically coupled to the first electrode and a second connector electrically coupled to the second electrode. The first connector, the second connector, or both, are configured to receive the signal.

20 Claims, 10 Drawing Sheets

(51) Int. Cl.

| | |
|---|---|
| ***H01P 5/02*** | (2006.01) |
| *H05H 1/46* | (2006.01) |
| *H01P 5/107* | (2006.01) |

(56) References Cited

U.S. PATENT DOCUMENTS

| | | | | |
|---|---|---|---|---|
| 6,046,659 | A | 4/2000 | Loo et al. | |
| 6,396,449 | B1 | 5/2002 | Osterhues et al. | |
| 8,325,495 | B2 | 12/2012 | Lam et al. | |
| 8,575,844 | B1 * | 11/2013 | Landt | H01J 23/34 313/484 |
| 2004/0262645 | A1 | 12/2004 | Huff et al. | |
| 2006/0220980 | A1 * | 10/2006 | Metz | H01Q 1/366 343/909 |
| 2013/0126513 | A1 | 5/2013 | Marakhtanov et al. | |

OTHER PUBLICATIONS

EP Examination Report for application No. 15191019.7 dated Jan. 3, 2017, 5.

* cited by examiner

PLASMA-INTEGRATED SWITCHING DEVICES

FIELD OF THE DISCLOSURE

The present disclosure relates to plasma-integrated switching devices.

BACKGROUND

Components such as low-noise amplifiers in antennas and direction arrival estimation systems may be susceptible to high-power microwave attacks or interference from other devices located near the components. In phased array antenna systems and certain other communication systems, limiters based on silicon carbide (SiC), gallium arsenide (GaAs), or gallium nitride (GaN) may be placed in-line to provide protection against high-power signals. For example, the SiC-based limiters may be placed between an antenna and the low-noise amplifiers to reduce the amount of power that goes through the low-noise amplifiers. The SiC-based limiters may be integrated at each element of a phased array antenna. Since phased array antennas may include thousands of elements, placing limiters at each element may introduce significant costs and complexity. In addition, limiters introduce appreciable insertion losses.

Another method of protecting electronic devices, such as low-noise amplifiers, from exposure to high-power electromagnetic radiation, e.g., high-power microwave radiation, may be to place a switchable transistorized mesh system in front of an antenna array. The switchable transistorized mesh system may include conductors arranged in a mesh with discontinuities. A transistor may be present at each discontinuity. When the transistors are off (e.g., behaving like an open switch), electromagnetic energy may pass through the mesh. When the transistors are on (e.g., behaving like a closed switch), the mesh is effectively continuous, and electromagnetic energy may be reflected from the mesh. Since each transistor is provided with power for switching, significant complexity may be added by using such a switchable transistorized mesh system. Further, threat detection, propagation of the control signal, and switching time of the transistors may add an unacceptable delay.

SUMMARY

Particular embodiments disclosed herein include a switching device employing a plasma phase change material. The plasma phase change material may be substantially non-conductive in a first phase and substantially conductive in a second phase. The switching device may include electrodes within a sealed chamber enclosing the plasma phase change material. The electrodes may be physically separated from each other. The phase of the plasma phase change material may be transitioned based at least in part on characteristics of a signal applied to one or more of the electrodes. Thus, the switching device may selectively inhibit transmission of a signal through the switching device when the plasma phase change material in the first phase, but allow transmission of the signal through the switching device when the plasma phase change material is in the second phase.

In a particular embodiment, a switching device includes a first electrode at least partially disposed within a sealed chamber. The sealed chamber encloses a quantity of a plasma phase change material (e.g., a gas). The switching device includes a second electrode at least partially disposed within the sealed chamber. The second electrode is physically separated from the first electrode. When the gas is subjected to a signal (e.g., by applying the signal to one or more of the first or second electrodes) that satisfies a threshold, the gas forms a plasma within the sealed chamber. The first electrode is electrically coupled to the second electrode via the plasma when the plasma is formed. The first electrode is electrically isolated from the second electrode when the plasma is not formed. The switching device includes a first connector electrically coupled to the first electrode and a second connector electrically coupled to the second electrode. The first connector, the second connector, or both, are configured to receive the signal.

In a particular embodiment, a method includes applying a signal to a first electrode of a switching device. The switching device includes the first electrode at least partially disposed within a sealed chamber. The sealed chamber encloses a quantity of a plasma phase change material (e.g., a gas). The switching device includes a second electrode at least partially disposed within the sealed chamber. The second electrode is physically separated from the first electrode. The method includes forming a plasma in the gas when the signal satisfies a threshold. The first electrode is electrically coupled to the second electrode via the plasma when the plasma is formed. The first electrode is electrically isolated from the second electrode when the plasma is not formed.

In another particular embodiment, a system includes a radio frequency (RF) circuit, an antenna interface, and a switching device. The switching device includes a first electrode coupled to the RF circuit and at least partially disposed within a sealed chamber. The sealed chamber encloses a quantity of a plasma phase change material (e.g., a gas). The switching device includes a second electrode coupled to the antenna interface and at least partially disposed within the sealed chamber. The second electrode is physically separated from the first electrode. When the gas is subjected to a signal (e.g., by applying the signal to one or more of the first or second electrodes) that satisfies a threshold, the gas forms a plasma within the sealed chamber. The first electrode is electrically coupled to the second electrode via the plasma when the plasma is formed. The first electrode is electrically isolated from the second electrode when the plasma is not formed.

The features, functions, and advantages that have been described can be achieved independently in various embodiments or may be combined in yet other embodiments, further details of which are disclosed with reference to the following description and drawings.

DETAILED DESCRIPTION

Figure 1:
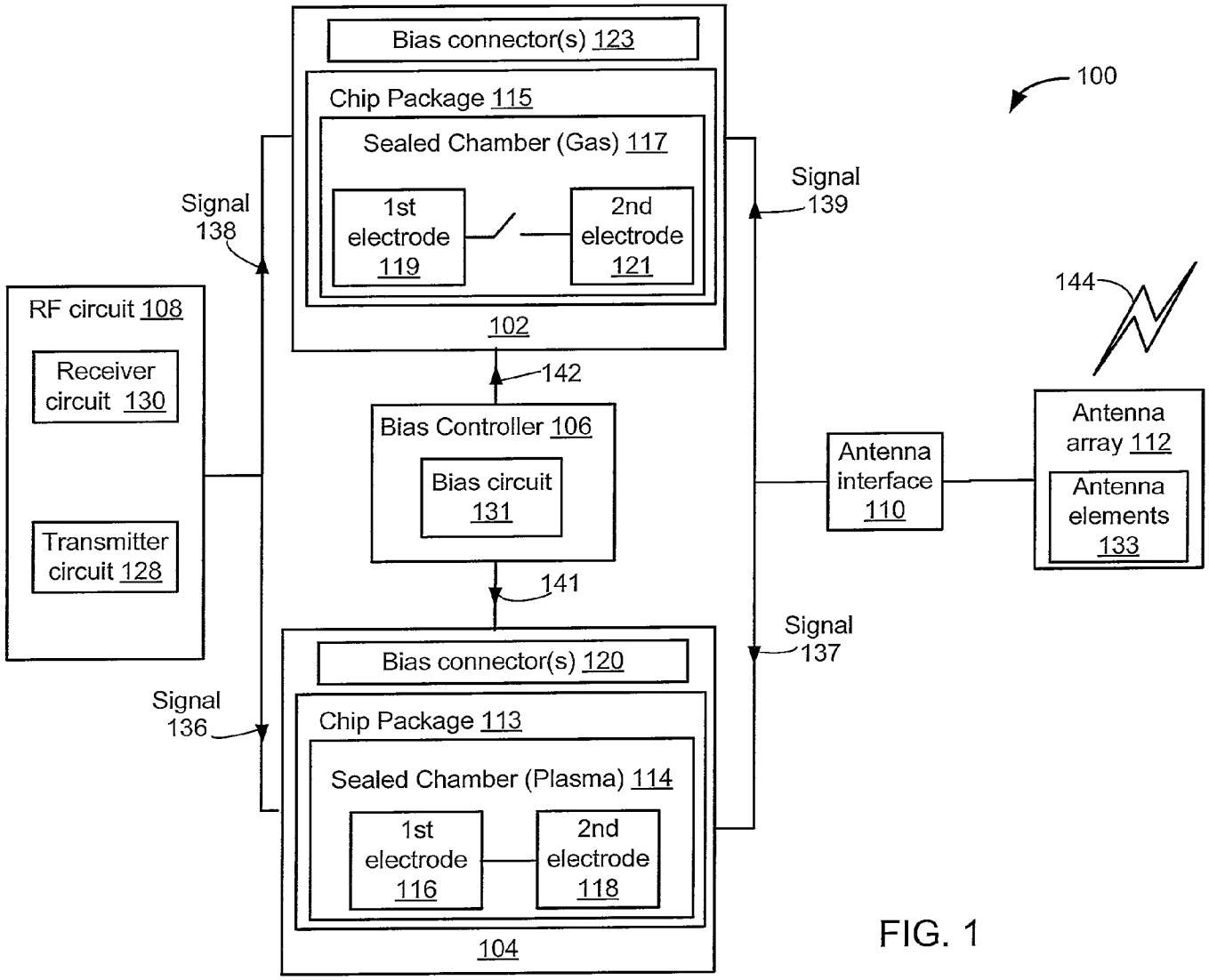
FIG. 1 is a block diagram that illustrates a particular embodiment of a communication system including a particular embodiment of a plasma-integrated switching device.

Particular embodiments of the present disclosure are described below with reference to the drawings. In the description, common features are designated by common reference numbers throughout the drawings.

Embodiments disclosed herein include a switching device employing a plasma phase change material. The plasma phase change material may be substantially non-conductive in a first phase and substantially conductive in a second phase, or vice versa. As used herein, a substantially non-conductive material refers to a material that has few mobile charge carriers, such as an insulator or dielectric. Thus, a substantially non-conductive material has a high dielectric constant. In contrast, a substantially conductive material herein refers to a material with an abundance of moveable charge carriers, such as a plasma. To illustrate, the plasma phase change material may be a gas that undergoes a gas-to-plasma phase transition. The phase transition from the first phase to the second phase may be triggered responsive to application of electrical energy (e.g., electric or electromagnetic fields) to the gas.

In a particular embodiment, when a plasma is formed between conductive elements, the plasma may be a cold plasma. A cold plasma may be only partially ionized. For example, in a cold plasma as little as about 1% of a gas may be ionized. This is in contrast to a thermal or hot plasma, in which a much higher proportion of the gas may be ionized.

In some embodiments, the switching device includes a chip package that includes a sealed chamber (e.g., a hermetically sealed cavity) encasing the plasma phase change material. In some embodiments, the switching device includes electrodes that are at least partially disposed within the sealed chamber. The electrodes are physically separate from each other, and a gap between the electrodes is occupied by the plasma phase change material. For example, an area between the electrodes may include one or more discontinuities filled by the plasma phase change material.

As mentioned above, the phase transition from the first phase to the second phase may be triggered responsive to application of electrical energy (e.g., electric or electromagnetic fields) to the plasma phase change material. The electrical energy may be applied to the plasma phase change material responsive, at least partially, to application of a signal (e.g., a direct current (DC) signal or an RF signal) to one or more of the electrodes within the sealed chamber. Subjecting the plasma phase change material to the DC signal or the RF signal (e.g., by applying the DC signal or the RF signal to one or more of the electrodes) may alone, or in concert with other factors (e.g., a temperature of the plasma phase change material, a bias current applied to the plasma phase change material, another signal applied to the plasma phase change material, or another factor that preconditions or biases the phase change material to be near a phase transition critical point), cause the plasma phase change material to transition from a conductive phase to a non-conductive phase, or vice versa. Thus, the switching device may selectively inhibit transmission of the signal between the electrodes (e.g., across the gap) based at least in part on characteristics of the signal applied to the electrodes.

Referring to FIG. 1, a particular embodiment of a communications system employing multiple switching devices including one or more chip packages is depicted and generally designated 100. The communications system 100 includes a first switching device 102, a second switching device 104, a bias controller 106, an RF circuit 108, an antenna interface 110, and an antenna array 112. In some embodiments, the communications system 100 is a RADAR system, and the RF circuit 108, the antenna interface 110, and the first and second switching devices 102 and 104, are components of the RADAR system. As used herein, the term radio frequency includes electromagnetic signals having a frequency between 300 gigahertz (GHz) and 3 kilohertz (KHz). In some embodiments, the antenna array 112 includes multiple antenna elements 133. In some embodiments, the RF circuit 108 includes a transmitter circuit 128, a receiver circuit 130, or both.

In some embodiments, at least two switching devices are coupled to a particular antenna element of the multiple antenna elements 133. For example, the first switching device 102 and the second switching device 104 may be coupled to the particular element of the multiple antenna elements 133.

The first switching device 102 includes a chip package 115 including a sealed chamber 117, and the second the switching device 104 includes a chip package 113 including a sealed chamber 114. The sealed chamber 117 of the first switching device 102 includes a first electrode 119 and a second electrode 121. The sealed chamber 114 of the second switching device 104 includes a first electrode 116 and a second electrode 118. The first electrode 119 and the second electrode 121 of the first switching device 102 are physically separated from each other. The first electrode 116 and the second electrode 118 of the second switching device 104 are physically separated from each other. Each of the sealed chambers 114 and 117 encloses a plasma phase change material. For example, an area between the first electrode 119 and the second electrode 121 of the first switching device 102 may be occupied by a gas.

The second electrode 121 of the first switching device 102 may be coupled to the antenna interface 110, and the second electrode 118 of the second switching device 104 may be coupled to the antenna interface 110. In some embodiments, one or more of the first electrodes 116 and 119 are coupled to the RF circuit 108. In some examples, the first electrode 116 of the second switching device 104 is coupled to the transmitter circuit 128, and the first electrode 119 of the first switching device 102 is coupled to the receiver circuit 130. One or more of the first and second switching devices 102 and 104 may selectively inhibit transmission of a signal 136, 137, 138, or 139 (e.g., a DC signal or an RF signal) between the electrodes (e.g., across the gap) based at least in part on characteristics of the signal 136, 137, 138, or 139 applied to one or more of the electrodes 116, 118, 119, or 121, respectively.

In some embodiments, the first switching device 102 transitions to the substantially conductive state when one or more characteristics of the signal 139 applied to the second electrode 121 of the first switching device 102 satisfy a first threshold. Alternatively or additionally, the first switching device 102 may transition to the substantially non-conductive state when one or more characteristics of the signal 138 applied to the first electrode 119 of the first switching device 102 satisfy the first threshold. In some embodiments, the second switching device 104 transitions to a substantially conductive state when one or more characteristics of the signal 136 applied to the first electrode 116 of the second switching device 104 satisfy a second threshold. Alternatively or additionally, the second switching device 104 may transition to the substantially non-conductive state when one or more characteristics of the signal 137 applied to the second electrode 118 of the second switching device 104 satisfy the second threshold. It will be understood that switching devices described as transitioning to the substantially conductive state when one or more characteristics of the signal 136, 137, 138, or 139 satisfy a threshold may alternatively be configured to transition to the substantially non-conductive state when one or more characteristics of the signal 136, 137, 138, or 139 satisfy the threshold. The first and second thresholds may correspond to a power (e.g., peak power or intensity) threshold, a frequency threshold, or both.

Each of the switching devices 102 and 104 may be a passive switch and/or an active switch. A passive switch responds to the signal 136, 137, 138, or 139 applied to the electrodes, while an active switch may operate in concert with other factors to control a state of the plasma phase change material. For example, an active switch may include a bias connector such as the bias connector 120 or 123. In this example, the first and/or second thresholds are adjustable (e.g., may be reduced or increased) by applying one or more bias signals 141 or 142 to one or more bias connectors 120 and/or 123 coupled to one or more of the electrodes 116, 118, 119, and/or 121. A passive switch may not include a bias connector 120/123. Accordingly, the plasma phase change material in a passive switch may form a plasma responsive only to a signal from the RF circuit 108 and/or the antenna array 112 (e.g., the signal 136, 137, 138, or 139).

During operation in a receive mode, a signal 144, such as an RF signal, may be received (e.g., a "received signal") at the antenna array 112. The received signal 144 (or the signal 139 derived therefrom) is applied to the second electrode 121 of the first switching device 102. The signal 139 may include first characteristics (e.g., power or intensity or frequency). When the first characteristics satisfy the first threshold, and the plasma phase change material within the sealed chamber 117 is subjected to the signal 139 (e.g., the signal 139 is applied to one or more of the first or second electrodes 119 and/or 121), the plasma phase change material within the sealed chamber 117 forms a plasma coupling the first electrode 119 and the second electrode 121. When the first characteristics do not satisfy the first threshold, the plasma phase change material within the sealed chamber 117 does not form a plasma, thereby electrically isolating the first and second electrodes 119 and 121. During the receive operation, the plasma phase change material within the sealed chamber 117 of the first switching device 102 (coupled to the receiver circuit 130) may form a plasma, and the plasma phase change material within the sealed chamber 114 of the second switching device 104 (coupled to the transmitter circuit 128) may not form a plasma.

For a passive switch, the first threshold may not be adjustable. Thus, for a passive switch, the first switching device 102 may electrically couple the first and second electrodes 119, 121 based wholly on the first characteristics. However, in embodiments that include an active switch, the first threshold is adjustable (e.g., may be reduced or increased) by applying the bias signal 142 to the bias connector of the first switching device 102. For example, when the first switching device 102 is an active switch, the bias controller 106 may apply the bias signal 142 to the bias connector 123 of the first switching device 102 to adjust the first threshold of the first switching device 102. Thus, when not adjusted (e.g., in a passive switch or an un-biased active switch), the first characteristics may not satisfy the first threshold, thereby causing the plasma phase change material to remain in the gas state. However, when the first threshold is adjusted in an active switch embodiment using the bias signal 142, the first characteristics may satisfy the adjusted first threshold, causing the plasma phase change material to form a plasma within the sealed chamber 117. Accordingly, for an active switch, the first switching device 102 may electrically couple the electrodes 119 and 121 based on both the first characteristics and the adjusted threshold.

In some embodiments, the first threshold (e.g., a peak power level or a frequency) is satisfied when exceeded. For example, when the first characteristics (e.g., a power level or frequency of the signal applied to the first electrode) is/are greater than the first threshold, the plasma phase change material forms a plasma within the sealed chamber 117, thereby electrically coupling the first and second electrodes 119 and 121, allowing conduction of the signal 139 across the gap between the first and second electrodes 119 and 121. When the first characteristics do not exceed the first threshold, the plasma phase change material does not form a plasma within the sealed chamber 117, thereby electrically isolating the first and second electrodes 119 and 121 from each other, preventing conduction of the signal 139 across the gap.

As described above, in some embodiments, the first threshold is adjustable. For example, when the first threshold is not adjusted (e.g., in a passive switch or an un-biased active switch), the first characteristics may not exceed the first threshold, resulting in the plasma phase change material not forming a plasma within the sealed chamber 117, thereby electrically isolating the first and second electrodes 119 and 121. However, when the first threshold is adjusted (e.g., reduced), the first characteristics may exceed the adjusted first threshold, causing the plasma phase change material to form a plasma within the sealed chamber 117, thereby electrically coupling the first and second electrodes 119 and 121. As another example, when the first threshold is not adjusted (e.g., in a passive switch or an un-biased active switch), the first characteristics may exceed the first threshold, resulting in the plasma phase change material forming a plasma within the sealed chamber 117, thereby electrically coupling the first and second electrodes 119 and 121. However, when the first threshold is adjusted (e.g., increased), the first characteristics may not exceed the adjusted first threshold, causing the plasma phase change material to not form a plasma within the sealed chamber 117, thereby electrically isolating the first and second electrodes 119 and 121.

In other embodiments, the first threshold is satisfied when not exceeded. For example, when the first characteristics do not exceed the first threshold, the plasma phase change material forms a plasma within the sealed chamber 117, thereby electrically coupling the first and second electrodes 119 and 121. When the first characteristics do exceed the first threshold, the plasma phase change material does not form a plasma within the sealed chamber 117, thereby electrically isolating the first and second electrodes 119 and 121, preventing conduction of the signal 139 across the gap.

As explained above, in some embodiments, the first threshold is adjustable. For example, when not adjusted (e.g., in a passive switch or an un-adjusted active switch), the first characteristics may exceed the first threshold, resulting in the plasma phase change material not forming a plasma within the sealed chamber 117. However, when the first threshold is adjusted by the bias signal 142, the first threshold may be increased such that the first characteristics do not exceed the adjusted first threshold, causing the plasma phase change material to form a plasma in the sealed chamber 117, thereby electrically coupling the first and second electrodes 119 and 121. As another example, when not adjusted (e.g., in a passive switch or an un-biased active switch), the first characteristics may not exceed the first threshold, resulting in the plasma phase change material forming a plasma within the sealed chamber 117. When the first threshold is adjusted by the bias signal 142, the first threshold may decreased such that the first characteristics do exceed the adjusted first threshold, causing the plasma phase change material to not form a plasma in the sealed chamber 117, thereby electrically isolating the first and second electrodes 119 and 121.

In some embodiments, the second threshold associated with the second switching device 104 corresponds to a power (e.g., a peak power or intensity) threshold, a frequency threshold, or both, and may be adjustable as described above with respect to the first switching device 102. For example, during a transmit operation, the signal 136 (e.g., a DC signal or an RF signal) from the transmitter circuit 128 may be applied to the second switching device 104 at the first electrode 116 (e.g., to be transmitted by the antenna array 112). The signal 136 may have second characteristics (e.g., a power, intensity or frequency). The plasma phase change material within the second switching device 104 may form a plasma within the sealed chamber 114 based on whether the second characteristics satisfy the second threshold, as described with reference to the first switching device 102. For example, when the second characteristics satisfy the second threshold, and when the plasma phase change material within the sealed chamber 114 is subjected to the signal 136 (e.g., by applying the signal 136 to one or more of the first and second electrodes 116 and 118), the plasma phase change material within the sealed chamber 114 may form a plasma coupling the first electrode 116 and the second electrode 118. When the second characteristics do not satisfy the second threshold, the plasma phase change material within the sealed chamber 114 may remain in the gas state, electrically isolating the first and second electrodes 116 and 118.

In some embodiments, the second switching device 104 is an active switch. In such embodiments, the second threshold is adjustable (e.g., may be reduced or increased) by applying the bias signal 141 to the bias connector 120 of the second switching device 104. For example, the bias signal 141 may be a DC signal or an RF signal. The bias controller 106 may be configured to adjust the second threshold by applying the bias signal 141 to the bias connector 120.

For example, when not adjusted (e.g., in a passive switch or an un-biased active switch), the second characteristics may not satisfy (e.g., may exceed or may not exceed, as described above) the second threshold, resulting in the plasma phase change material in the sealed chamber 114 not forming a plasma, thereby electrically isolating the first and second electrodes 116 and 118. However, when the second threshold is adjusted (e.g., reduced, as described above) based on the bias signal 141, the second characteristics may satisfy (e.g., may exceed) the adjusted second threshold, causing the plasma phase change material within the sealed chamber 114 to form a plasma, thereby electrically coupling the first and second electrodes 116 and 118. As another example, when not adjusted (e.g., in a passive switch or an un-biased active switch), the second characteristics may satisfy (e.g., may exceed) the second threshold, resulting in the plasma phase change material in the sealed chamber 114 forming a plasma, thereby electrically coupling the first and second electrodes 116 and 118. However, when the second threshold is adjusted (e.g., increased, as described above) based on the bias signal 141, the second characteristics may not satisfy (e.g., may not exceed) the adjusted second threshold, causing the plasma phase change material within the sealed chamber 114 to not form a plasma, thereby electrically isolating the first and second electrodes 116 and 118. Thus for an active switch, the second switching device 104 may electrically couple the electrodes based on characteristics of the signal 141 (e.g., a signal to be transmitted) and based on an adjusted threshold.

In some examples, during a transmit operation, the plasma phase change material of the first switching device 102 (coupled to the receiver circuit 130) does not form a plasma, and the plasma phase change material of the second switching device 104 (coupled to the transmitter circuit 128) does form a plasma. In this example, the first switching device 102 is in an open (e.g., non-conducting) state, and the second switching device 104 is in a closed (e.g., conducting) state.

The first threshold and the second threshold may be adjustable independently of each other responsive to bias signals 141 or 142 applied by the bias circuit 131. For example, in some embodiments, the bias circuit 131 is configured to adjust the first threshold without adjusting the second threshold, or vice versa. In some examples, the bias circuit 131 is additionally, or alternatively, configured to inversely adjust the first and second thresholds (e.g., increase the first threshold while decreasing the second threshold), or adjust the first and second thresholds different amounts.

Figure 2:
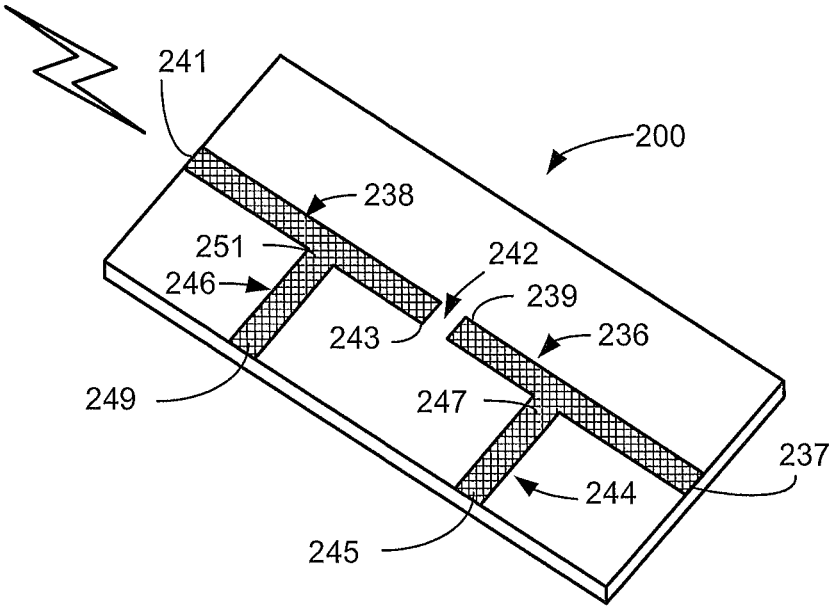
FIG. 2 is a block diagram that illustrates a particular embodiment of a printed circuit board of a particular embodiment of a switching device that includes one or more bias connectors.

A printed circuit board device 200 including connectors (e.g., microstrips or other transmission lines) to which electrodes of a chip package (e.g., the chip packages 113 and/or 115 of FIG. 1) are configured to be coupled is depicted in FIG. 2. The printed circuit board device 200 includes a first printed circuit board connector (e.g., a first length of microstrip) 236 and a second printed circuit board connector (e.g., a second length of microstrip) 238. One or more signals (e.g., the signals 136, 137, 138, or 139 of FIG. 1) may be provided to a switching device (e.g., the first switching device 102 or the second switching device 104 of FIG. 1) via one or more of the printed circuit board connectors 236, 238. The first printed circuit board connector 236 includes a first end 237 and a second end 239. The second printed circuit board connector 238 includes a first end 241 and a second end 243. In some examples, the first printed circuit board connector 236 and the second printed circuit board connector 238 are linearly aligned on the printed circuit board device 200, with the second end 239 of the first printed circuit board connector 236 separated from the second end 243 of the second printed circuit board connector 238 by a gap 242.

In some embodiments (e.g., when an active switching device is used), the printed circuit board device 200 includes one or more additional connectors (e.g., microstrips or other transmission lines) 244 and/or 246. The one or more of the additional connectors 244 and/or 246 may include bias connectors. The first threshold and/or the second threshold described above may be adjustable based on a bias signal applied to one or more of the bias connectors. A first of the one or more additional connectors 244 includes a first end 245 and a second end 247. In some examples, the second end 247 is connected to the first printed circuit board connector 236. A second of the one or more additional connectors 246 includes a first end 249 and a second end 251. In some examples, the second end 251 is connected to the second printed circuit board connector 238.

Figure 3:
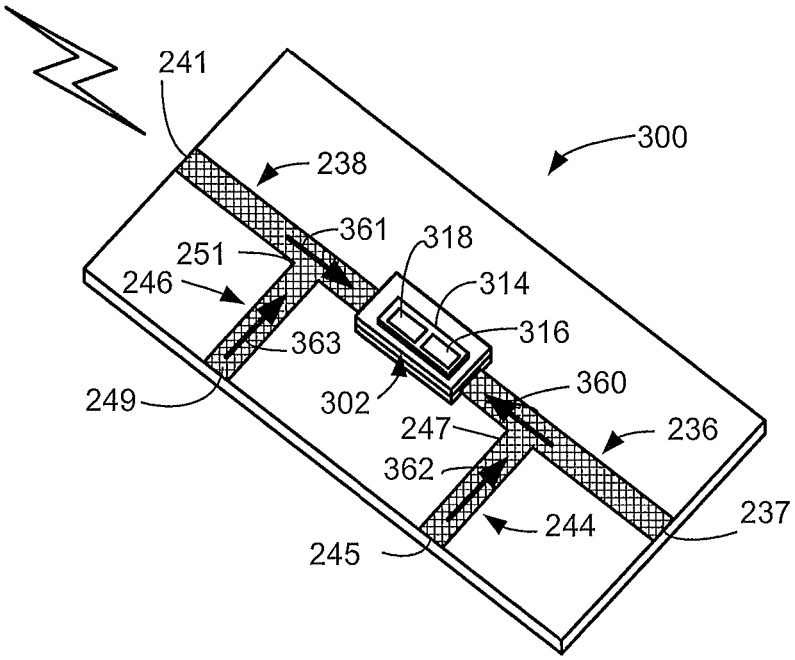
FIG. 3 illustrates a particular embodiment of a switching device including a particular embodiment of a chip package coupled to the particular embodiment of the printed circuit board of FIG. 2.

A switching device 300 including a chip package 302 coupled to the printed circuit board 200 of FIG. 2 is depicted in FIG. 3. The chip package 302 may correspond to the chip package 113 and/or 115 of FIG. 1. The switching device 300 may correspond to the first switching device 102 or the second switching device 104 of FIG. 1. The switching device 300 includes a first electrode 316 and a second electrode 318 at least partially disposed within a sealed chamber 314. The first electrode 316 may correspond to one or more of the first electrodes 116/119 of FIG. 1 and the second electrode 318 may correspond to one or more of the second electrodes 118/121 of FIG. 1. The sealed chamber 314 may correspond to one or more of the sealed chambers 114 or 117 of FIG. 1.

The first electrode 316 is physically separated from the second electrode 318. When subjected to a signal 360 that satisfies a threshold (e.g., the first threshold or the second threshold described above), the gas within the sealed chamber 314 forms a plasma within the sealed chamber 314, thereby coupling the first electrode 316 to the second electrode 318. Additionally or alternatively, when subjected to a signal 361 that satisfies a threshold (e.g., the first threshold or the second threshold described above), the gas within the sealed chamber 314 forms a plasma within the sealed chamber 314, thereby coupling the first electrode 316 to the second electrode 318. When the plasma is not formed within the sealed chamber 314, the first electrode 316 is electrically isolated from the second electrode 318.

The switching device 300 includes connectors (e.g., a first connector 404 and a second connector 406 of FIG. 4) coupled to the first and second electrodes 316 and 318, respectively. In some examples, one or more of the first and second printed circuit board connectors 236 or 238 are coupled to the first or second connectors 404 or 406. The first or second connectors are configured to receive the signal 360 or 361 via one or more of the printed circuit board connectors 236 and/or 238 and to apply the signal 360 or 361 to the first and/or second electrodes 316 and/or 318.

In some examples, the switching device 300 includes the one or more additional connectors (e.g., the one or more bias connectors) 244 and/or 246 as described above. For example, the one or more of the additional connectors 244 and/or 246 may correspond to either of the bias connectors 120 or 123 of FIG. 1. One or more of the one or more additional connectors 244 and/or 246 may be coupled to the first electrode 316, the second electrode 318, or both. To illustrate, the first electrode 316 may be coupled to the additional connector 244 (e.g., a first bias connector) via the first printed circuit board connector 236 (which may be coupled to the first connector 404 of FIG. 4). Alternatively, or in addition, the second electrode 318 may be coupled to the additional connector 246 (e.g., a second bias connector) via the printed circuit board connector 238 (which may be coupled to the second connector 406 of FIG. 4). One or more of the additional connectors 244 and/or 246 may be connected to a bias controller (e.g., the bias controller 106 of FIG. 1), while a different one of the one or more additional connectors 244 and/or 246 may be coupled to ground. The first and/or second thresholds described above may be adjusted by applying one or more bias signals 362 or 363 to the one or more additional connectors 244 and/or 246 that are connected to the bias controller (e.g., the bias controller 106 of FIG. 1).

The first end 237 of the first printed circuit board connector 236 may be coupled to an RF circuit (e.g., the transmitter circuit 128 or the receiver circuit 130 of the RF circuit 108 of FIG. 1), and the first end 241 of the second printed circuit board connector 238 may be connected to an antenna interface (e.g., the antenna interface 110 of FIG. 1). When the first end 237 of the first printed circuit board connector 236 is coupled to a transmitter circuit (e.g., the transmitter circuit 128 of FIG. 1), the first printed circuit board connector 236 is configured to receive the signal 360 (e.g., a transmit signal) from the transmitter circuit 128 and to conduct/apply the signal 360 to the first electrode 316. In some examples, the threshold (e.g., the first or second threshold described above) is adjustable by applying one or more of the bias signals 362 or 363 to the first electrode 316 or the second electrode 318 via one or more of the one or more additional connectors 244 and 246. When one or more characteristics of the signal 360 applied to the first electrode 316 satisfies the threshold, the plasma phase change material forms a plasma within the sealed chamber 314. In some examples, one or more of the bias signals 362 or 363 is a DC signal or an RF signal, and the signal 360 is a DC signal or an RF signal. When the plasma is formed in the sealed chamber 314 as described above, the signal 360 is conducted from the first electrode 316 to the second electrode 318 across the gap 242. The signal 360 may then be conducted along the second printed circuit board connector 238 toward an antenna interface (e.g., the antenna interface 110 of FIG. 1).

When the first end 237 of the first printed circuit board connector 236 is coupled to a receiver circuit (e.g., the receiver circuit 130 of FIG. 1), the second printed circuit board connector 238 is configured to receive the signal 361 (e.g., a received signal) from an antenna interface (e.g., the antenna interface 110 of FIG. 1) and/or to conduct/apply the signal 361 to the second electrode 318. In some examples, the threshold (e.g., the first or second threshold described above) is adjustable by applying one or more of the bias signals 362 or 363 to the first electrode 316 or the second electrode 318 via one or more of the one or more additional connectors 244 and 246. When one or more characteristics of the signal 361 applied to the second electrode 318 satisfies the threshold, the plasma phase change material forms a plasma within the sealed chamber 314. In some examples, one or more of the bias signals 362 or 363 is a DC signal or an RF signal, and the signal 361 is a DC signal or an RF signal. When the plasma is formed in the sealed chamber 314 as described above, the signal 361 is conducted from the second electrode 318 to the first electrode 316 across the gap 242. The signal 361 may then be conducted along the first printed circuit board connector 236 toward the receiver circuit 130 of FIG. 1.

Figure 4:
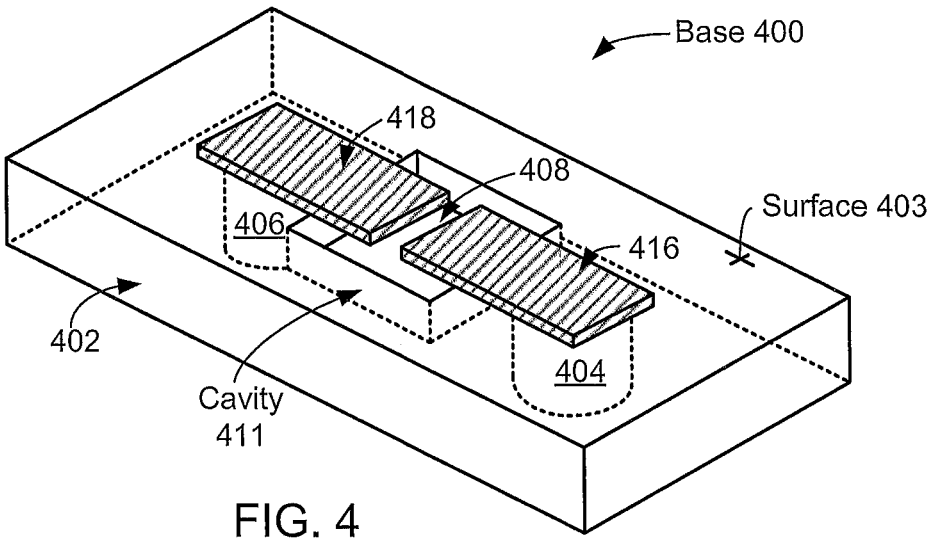
FIG. 4 illustrates a perspective view of a base of a particular embodiment of a chip package.

A portion of a chip package is depicted in FIG. 4. The portion of the chip package includes a base 400. The base 400 may include a substrate (e.g., a non-conductive substrate) 402 that is at least partially formed of a non-conductive or dielectric material, such as, for example, a ceramic material, a polymer material, glass, silicon, aluminum nitride, or a combination thereof. In some examples, the substrate 402 has a thickness sufficient to provide desired structural stability.

The chip package includes a first connector 404 and a second connector 406 extending at least partially through the substrate 402. In some examples, the first connector 404 and the second connector 406 are vias, and may be formed of one or more layers. The first and second conductors 404 and 406 may extend from a first end or surface (e.g., a bottom) of the substrate 402 to an opposing end or surface. The first and second connectors 404 and 406 may extend beyond one or more of the opposing surfaces. For example, the first and second conductors 404 and 406 may each include at least a portion that extends above the top end or surface of the substrate 402 in the orientation illustrated in FIG. 4.

The chip package includes first and second electrodes 416 and 418 coupled to the first and second connectors 404 and 406, respectively. In some examples, the first and second electrodes 416 and 418 correspond to the first and second electrodes 116, 119 and 118, 121 of FIG. 1 and/or the first and second electrodes 316 and 318 of FIG. 3. The first and second electrodes 416 and 418 may include or be formed of any suitable conductive material, such as silver, gold, copper, tungsten, aluminum, or another metal or conductor selected for a particular application. In a particular embodiment, materials used to form one or more of the substrate 402, the first and second connectors 404 and 406, and/or the first and second electrodes 416 and 418, are selected to facilitate low cost manufacturing. For example, the materials may be selected to facilitate manufacturing of the base 400 using relatively inexpensive fabrication techniques that are commonly employed to manufacture integrated circuits and other electronic devices. To illustrate, the materials may be selected to enable manufacturing the base 400 using wet etch, dry etch, deposition, photolithography, imprint lithography, chemical mechanical polishing, printing, or other additive or subtractive processes that are used to manufacture electronics and integrated circuits. In other examples, the base 400 may be cast, molded, machined (e.g., drilled), printed, or manufactured using another low cost process.

The first and second electrodes 416 and 418 are physically separated from each other. A gap 408 is located between the first and second electrodes 416 and 418. The gap 408 is filled with (e.g., occupied by) the phase change material as described above. Thus, when the gas (non-conductive) in the gap 408 transitions to a plasma state (conductive), the plasma provides a conductive medium via which signals can be electrically conducted between the electrodes 416 and 418.

The base 400 may include a cavity 411. The cavity 411 may be configured to reduce displacement current produced during plasma phase change material transitions.

Figure 5:
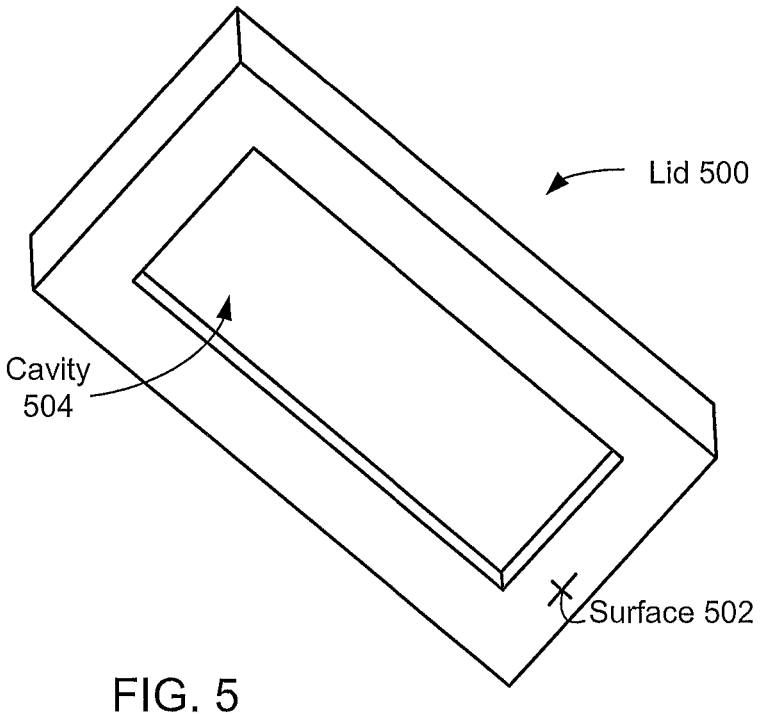
FIG. 5 illustrates a perspective view of lid of a particular embodiment of a chip package.

A lid (e.g., an "overlying substrate" or a "hermetic seal cap") 500 including cavity 504 is depicted in FIG. 5. The cavity 504 at least partially defines a chamber of a completed chip package. For example, the cavity 504 together with the cavity 411 of FIG. 4 may correspond to the sealed chambers 114/117 of FIG. 1 and/or the sealed chamber 314 of FIG. 3. The lid 500 is configured to couple (e.g., by bonding) to the base 400 of FIG. 4 to form a chip package including the sealed chamber. In some examples, when coupled to the base 400 of FIG. 4, the lid 500 hermetically seals the chamber. When the lid 500 is coupled to the base 400, one or more portions of the connectors 404 and 406 and the first and second electrodes 416 and 418 extend into the cavity 504.

Figure 6:
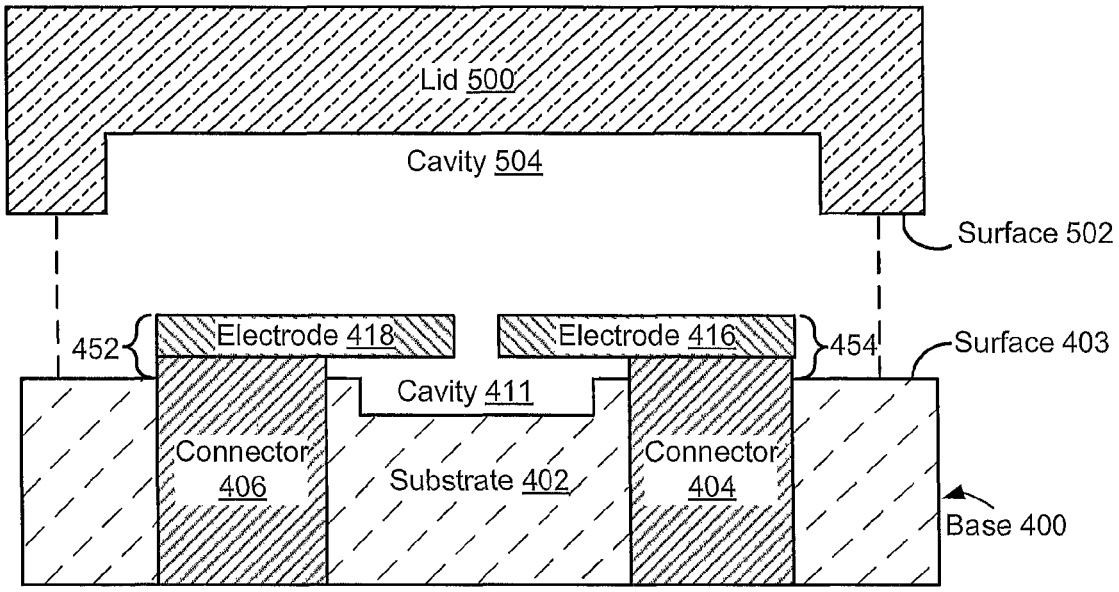
FIG. 6 illustrates a cross-sectional view of a particular embodiment of an unassembled chip package.

A cross sectional view of the base 400 and the lid 500 prior to being assembled to form a complete chip package is depicted in FIG. 6. One or more portions of the first and second connectors 404 and 406 and the first and second electrodes 416 and 418 may extend into the cavity 504. For example, the portions 452 and 454 of the first and second connectors 404 and 406 and the first and second electrodes 416 and 418 may extend into the cavity 504 when the base 400 is coupled to the lid 500.

Figure 7:
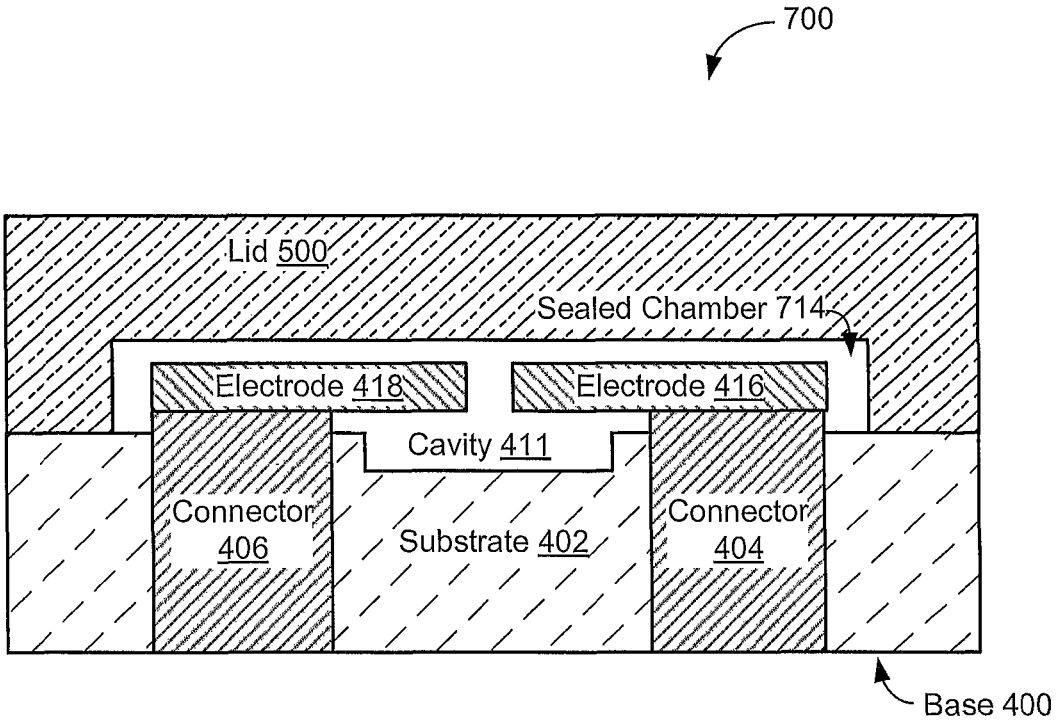
FIG. 7 illustrates a cross-sectional view of a particular embodiment of an assembled chip package.

A cross sectional view of an assembled chip package 700 is depicted in FIG. 7. In some examples, when assembled, the surface 502 of the lid 500 (shown in FIG. 6) is coupled to the surface 403 of the base 400 forming a sealed chamber 714. The sealed chamber 714 may correspond to the sealed chambers 114/117 of FIG. 1 or 314 of FIG. 3. The sealed chamber 714 includes at least portions of the first and second electrodes 416 and 418 as well as the plasma phase change material. Thus, when the plasma phase change material within the sealed chamber 714 is subjected to electrical energy that satisfies a particular threshold (e.g., the first or second threshold as described above), the plasma phase change material electrically couples the first and second electrodes 416 and 418 allowing conduction across the gap, as described above.

Figure 8:
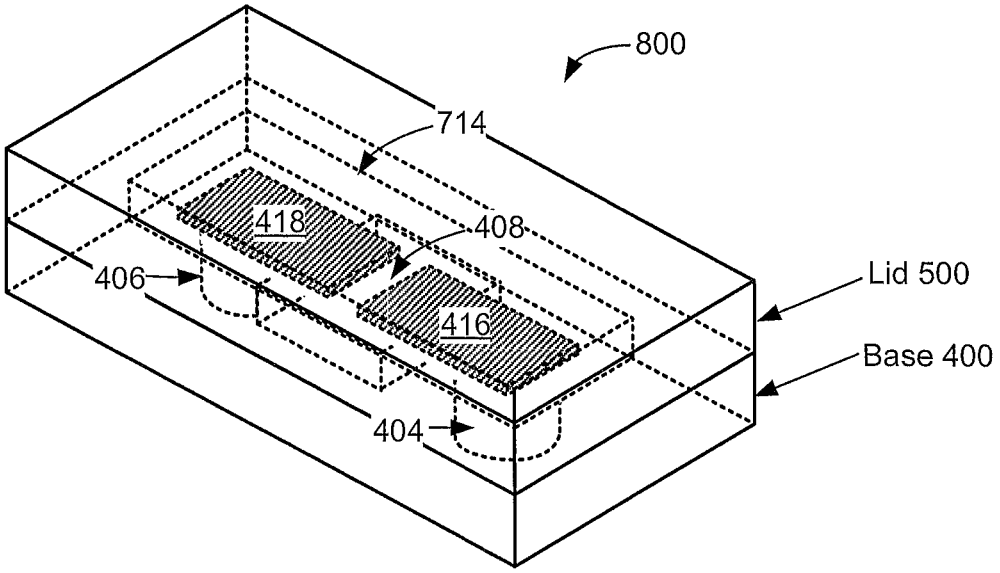
FIG. 8 illustrates a perspective view of a particular embodiment of an assembled chip package.

A perspective view of an assembled chip package 800 is depicted in FIG. 8. The sealed chamber 714 is formed when the lid 500 is coupled to the base 400. In some examples, the chamber 714 at least partially defined by a cavity 504 of the lid 500 and a cavity 411 of the base. The lid 500 may be bonded to the base 400 of FIG. 4 to form the chip package 800. The base 400 and the lid 500 may cooperate to hermetically seal the chamber 714.

Figure 9:
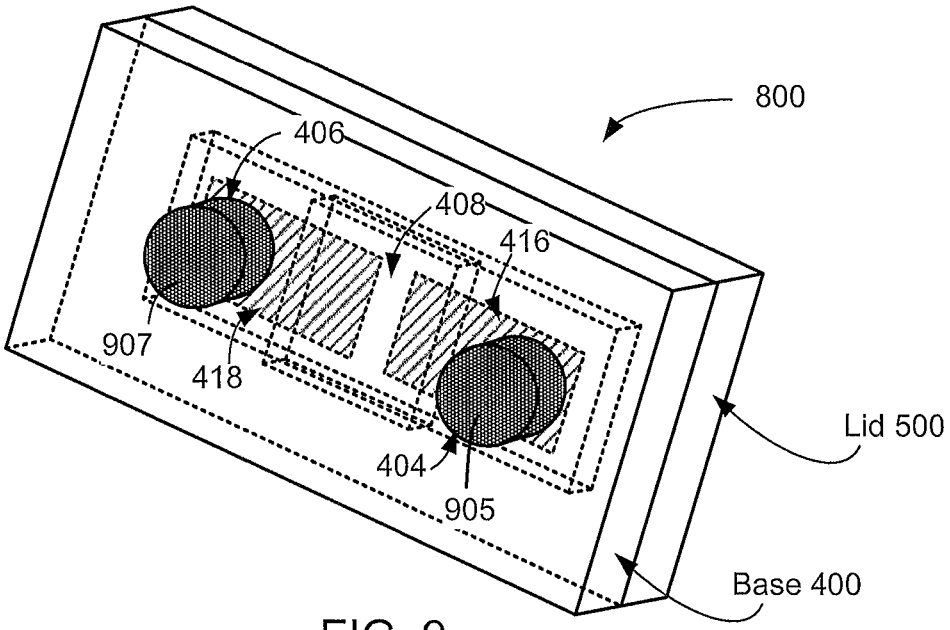
FIG. 9 illustrates a perspective view of a particular embodiment of an assembled chip package.

A bottom perspective view of the assembled chip package 800 is depicted in FIG. 9. The conductors 404 and 406 extend through a bottom surface of the chip package 800 exposing bottom surfaces 905 and 907 of the first and second connectors 404 and 406. The conductors 404 and 406 may thus be coupled (e.g., at the bottom surfaces 905 and 907) to one or more communication lines, such as one or more of the printed circuit board connectors 236, 238 of FIG. 2 and/or one or more of the additional connectors 244, 246 of FIG. 2. For example, the bottom surfaces 905 and 907 may be soldered to one or more of the printed circuit board connectors 236, 238 of FIG. 2 and/or one or more of the additional connectors 244, 246 of FIG. 2.

Figure 10:
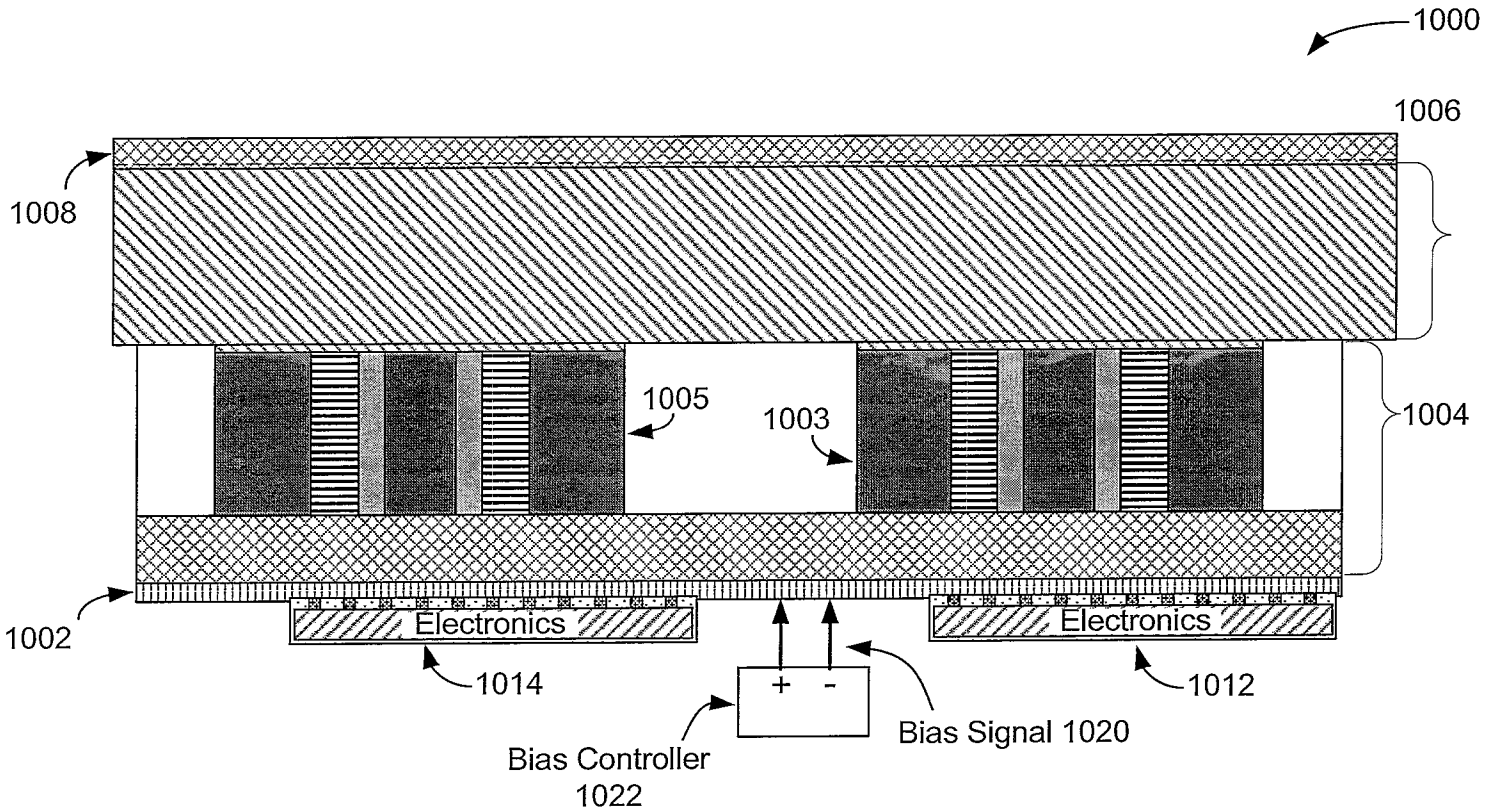
FIG. 10 illustrates a cross-sectional view of a particular embodiment of a wafer chip package.

A cross-sectional view of a device 1000 including a plasma phase change layer 1002 is depicted in FIG. 10. The device 1000 may correspond to the first switching device 102 and/or the second switching device 104 of FIG. 1. The device 1000 includes the plasma phase change layer 1002 formed between electronics 1012 and 1014 and an antenna integrated printed wiring board 1004. The antenna integrated printed wiring board 1004 may include coupling structures 1003 and 1005 that couple corresponding electronics 1012 and 1014 to antenna elements (e.g., the antenna elements 133 of FIG. 1). The electronics 1012 and 1014 may correspond to the transmitter circuit 128 and/or to the receiver circuit 130 of FIG. 1. The device 1000 may include a honeycomb 1006 between the antenna integrated printed wiring board 1004 and a wide-angle impedance matching layer 1008. The plasma phase change layer 1002 may correspond to an array of switching devices, such as one or more of the first and second switching devices 102 or 104 of FIG. 1. Each switching device of the array of switching devices of the plasma phase change layer 1002 may be coupled to a particular receiver circuit (e.g., the receiver circuit 130 of FIG. 1) or a particular transmitter circuit (e.g., the transmitter circuit 128 of FIG. 1), and/or to a particular antenna element (e.g., of the antenna elements 133 of FIG. 1).

During operation, a bias signal may be applied to the plasma phase change layer 1002 between the one or more electronics 1012 and 1014 causing one or more of the electronics 1012 or 1014 to be electrically coupled to, or decoupled from, a corresponding of the coupling structures 1003 and 1005. Each of the switching devices of the plasma phase change layer 1002 may be individually controllable by a bias signal 1020. Alternatively, or in addition, the switching devices of the plasma phase change layer 1002 may be controllable as a group. For example, a particular bias signal 1020 may be applied to the plasma phase change layer 1002 by a bias controller 1022 that causes a group of switching devices of the plasma phase change layer 1002 that are coupled to a receiver circuit (e.g., the receiver circuit 130 of FIG. 1) to form a plasma and thus conduct a received signal from a corresponding element (e.g., of the antenna elements 133 of FIG. 1) to a corresponding receiver circuit 130 of FIG. 1. As another example, a particular bias signal 1020 may be applied to the plasma phase change layer 1002 by the bias controller 1022 that causes a group of switching devices of the plasma phase change layer 1002 that are coupled to a transmitter circuit (e.g., the transmitter circuit 128 of FIG. 1) to form a plasma and thus conduct a signal to be transmitted from a corresponding transmitter circuit 128 of FIG. 1 to a corresponding antenna element (e.g., of the antenna elements 133 of FIG. 1). The device 1000 may provide for fast switching, low loss, low cost, small form factor, or a combination thereof.

Figure 11:
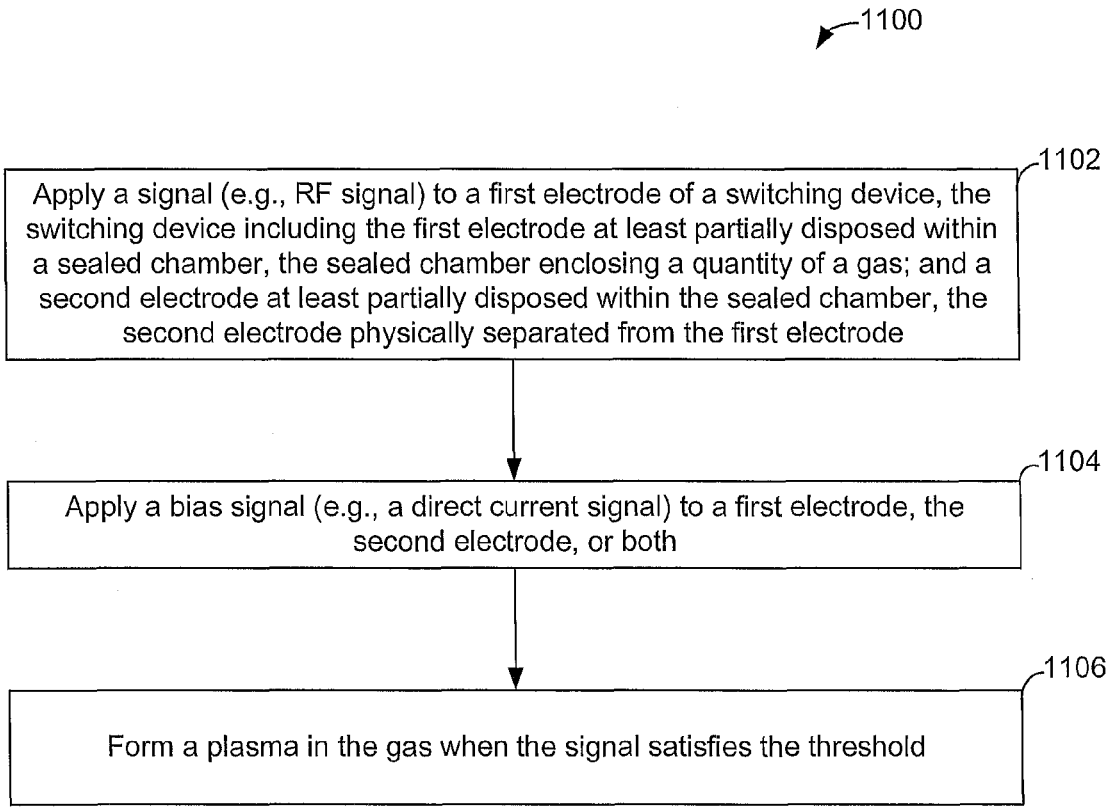
FIG. 11 is a flow chart of a particular embodiment of a switching method.

Referring to FIG. 11, a flow chart of a particular embodiment of a switching method 1100 is depicted. The method 1100 may be performed using a switching device 102 or 104 of FIG. 1. The method 1100 includes applying, at 1102, a signal (e.g., a DC signal or an RF signal) to a first electrode of a switching device, as described above. The first electrode may correspond to any of the electrodes 116, 118, 119, or 121 of FIG. 1, the electrodes 316 or 318 of FIG. 3, or the electrodes 416 or 418 of FIG. 4-9. The first electrode is at least partially disposed within a sealed chamber as described above. The sealed chamber may correspond to one or more of the sealed chambers 114 or 117 of FIG. 1, the sealed chamber 314 of FIG. 3, or the sealed chambers 714 of FIG. 7 or 8. The sealed chamber may enclose a quantity of a gas as described above. The switching device includes a second electrode at least partially disposed within the sealed chamber as described above. In some examples, the second electrode corresponds to any of the electrodes 116, 118, 119, or 121 of FIG. 1, the electrodes 316 or 318 of FIG. 3, or the electrodes 416 or 418 of FIG. 4-9. The second electrode is physically separated from the first electrode as described above.

The method 1100 further includes forming, at 1106, a plasma in the gas when the signal satisfies a threshold (e.g., the first threshold, the second threshold, the adjusted first threshold, or the adjusted second threshold), as described above. When the plasma is formed, the first electrode is electrically coupled to the second electrode via the plasma. When the plasma is not formed, the first electrode is electrically isolated from the second electrode.

The method 1100 may be employed using an active or passive switch as describe above. When an active switch is employed, the method 1100 further includes applying, at 1104, a bias signal (e.g., a direct current signal) to the first electrode, the second electrode, or both. The bias signal may be applied using the bias controller 106 of FIG. 1. Application of the bias signal may adjust the threshold, as described above.

The method 1100 of FIG. 11 may be initiated or controlled by a field-programmable gate array (FPGA) device, an application-specific integrated circuit (ASIC), a processing unit, such as a central processing unit (CPU), a digital signal processor (DSP), a controller (e.g., the bias controller 106 of FIG. 1), another hardware device, a firmware device, or any combination thereof. As an example, method 1100 may be initiated or controlled by one or more processors.

Figure 12:
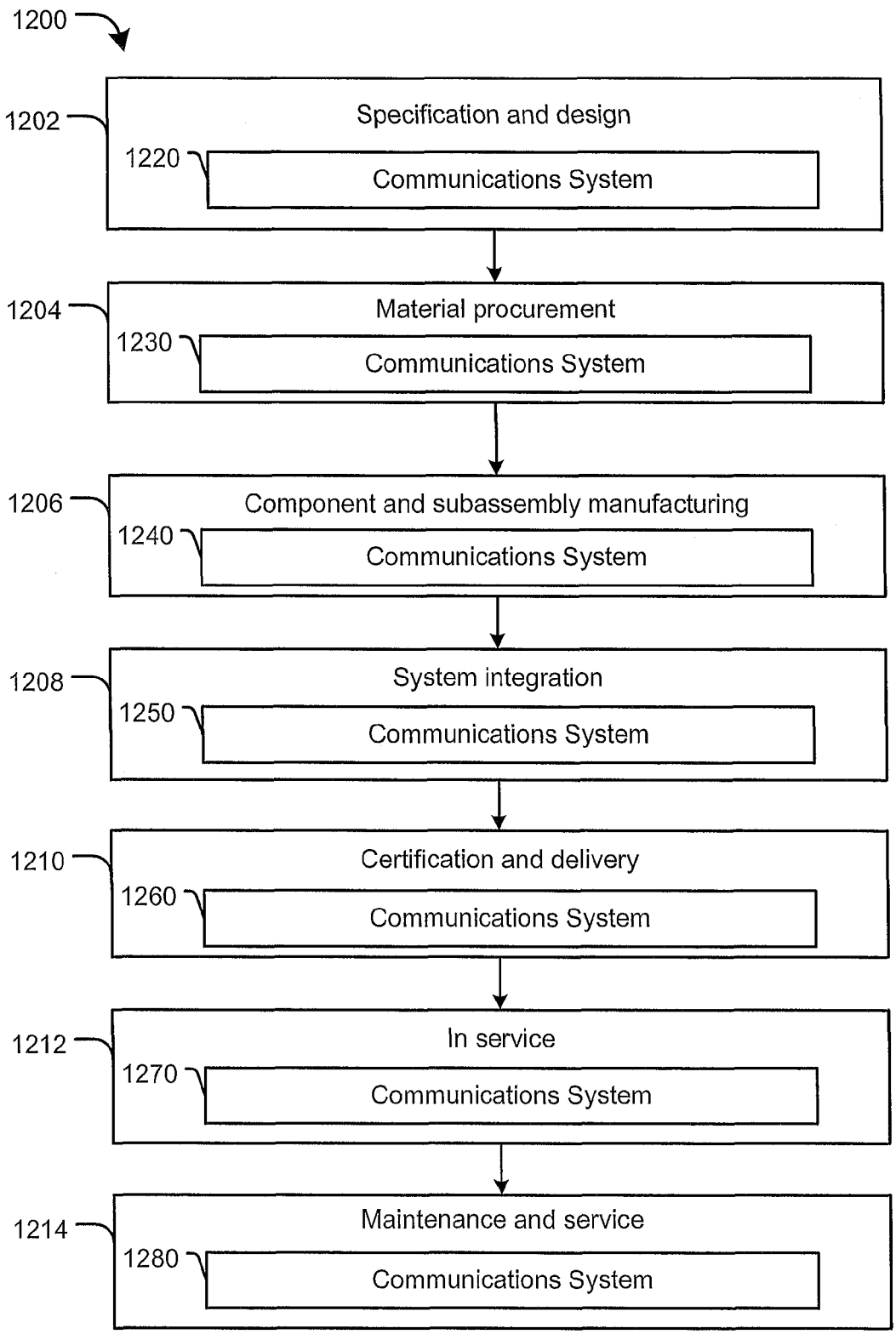
FIG. 12 is a flowchart illustrative of a life cycle of an aircraft that includes a particular embodiment of a communication system that includes a particular embodiment of a switching device.

Referring to FIG. 12, a flowchart illustrative of a life cycle of an aircraft that includes a communication system is shown and designated 1200. During pre-production, the exemplary method 1200 includes, at 1202, specification and design of an aircraft, such as the aircraft 1202 described with reference to FIG. 13. During specification and design of the aircraft, the method 1200 may include, at 1220, specification and design of a communication system including one or more switching devices. For example, the one or more switching devices may include one or more of the switching devices 102 or 104 of FIG. 1, 302 of FIG. 3, 800 of FIG. 8, or 1000 of FIG. 10. The communications system may correspond to the system of FIG. 1. At 1204, the method 1200 includes material procurement. At 1230, the method 1200 includes procuring materials (e.g., actuators, sensors, etc.) for the communications system, such as materials for the switching devices.

During production, the method 1200 includes, at 1206, component and subassembly manufacturing and, at 1208, system integration of the aircraft. The method 1200 may include, at 1240, component and subassembly manufacturing (e.g., producing the one or more switching devices) of the communication system and, at 1250, system integration (e.g., coupling the switching devices to one or more RF circuits, antenna interfaces, or bias signal controllers) of the communications system. At 1210, the method 1200 includes certification and delivery of the aircraft and, at 1212, placing the aircraft in service. Certification and delivery may include, at 1260, certifying the communications system. At 1270, the method 1200 includes placing the aircraft in service. While in service by a customer, the aircraft may be scheduled for routine maintenance and service (which may also include modification, reconfiguration, refurbishment, and so on). At 1214, the method 1200 includes performing maintenance and service on the aircraft. At 1280, the method 1200 includes performing maintenance and service of the communications system. For example, maintenance and service of the communications system may include replacing one or more of the switching devices.

Each of the processes of the method 1200 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

Figure 13:
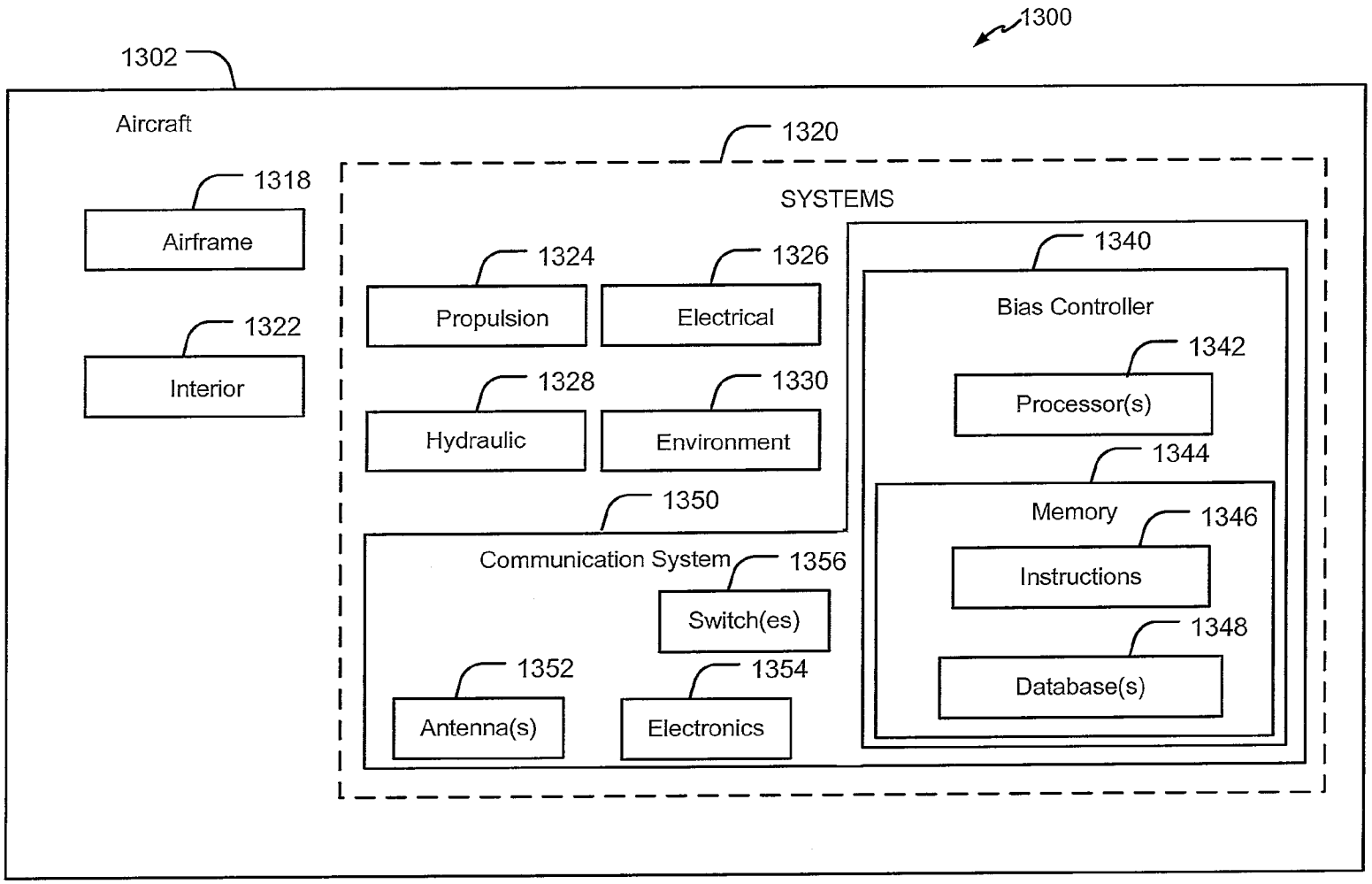
FIG. 13 is a block diagram of an illustrative embodiment of an aircraft that includes a particular embodiment of communication system that includes a particular embodiment of a switching device.

Referring to FIG. 13, a block diagram of an illustrative embodiment of an aircraft that includes a communication system is shown and designated 1300. As shown in FIG. 13, the aircraft 1302 produced by the method 1200 may include an airframe 1318 with a plurality of systems 1320 and an interior 1322. Examples of high-level systems 1320 include one or more of a propulsion system 1324, an electrical system 1326, a hydraulic system 1328, an environmental system 1330, and a communications system 1350. The communications system 1350 may include or correspond to the communications system 100 described with reference to FIG. 1 and may include a bias controller 1340, one or more antennas 1352, electronics 1354, and one or more switching devices 1356. The bias controller 1340 may include a processor 1342 and a memory 1344. In an embodiment, the bias controller 1340 may include or correspond to the bias controller 106 of FIG. 1. The memory 1344 may include instructions 1346 and a database(s) 1348. In an embodiment, the database(s) 1348 may include bias signal information. The processor 1342 may execute the instructions 1346 to determine whether to apply a bias signal to the switching devices 1356, determine bias signal characteristics, and/or determine bias signal application timing. Any number of other systems may be included. Although an aerospace example is shown, the embodiments described herein may be applied to other industries, such as the automotive industry.

Apparatus and methods embodied herein may be employed during any one or more of the stages of the method 1200. For example, components or subassemblies corresponding to production process 1208 may be fabricated or manufactured in a manner similar to components or subassemblies produced while the aircraft 1302 is in service, at 1212 for example and without limitation. Also, one or more apparatus embodiments, method embodiments, or a combination thereof may be utilized during the production stages (e.g., elements 1202-1210 of the method 1200), for example, by substantially expediting assembly of or reducing the cost of the aircraft 1302. Similarly, one or more of apparatus embodiments, method embodiments, or a combination thereof may be utilized while the aircraft 1302 is in service, at 1212 for example and without limitation, to maintenance and service, at 1214.

Examples described above illustrate but do not limit the disclosure. It should also be understood that numerous modifications and variations are possible in accordance with the principles of the present disclosure. Accordingly, the scope of the disclosure is defined by the following claims and their equivalents.

The illustrations of the examples described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than shown in the figures or one or more method steps may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. As the following claims reflect, the claimed subject matter may be directed to less than all of the features of any of the disclosed examples.

What is claimed is:

1. A switching device comprising:

a first electrode at least partially disposed within a sealed chamber;

a first connector extending external to the sealed chamber, electrically connected to the first electrode, and configured to electrically couple the first electrode to an electrical circuit;

a second electrode at least partially disposed within the sealed chamber, the second electrode physically separated from the first electrode;

a second connector extending external to the sealed chamber, electrically connected to the second electrode, and configured to electrically couple the second electrode to an antenna; and a gas disposed within the sealed chamber, the gas configured to form a plasma when subjected to electromagnetic radiation having particular characteristics, wherein communication signals can be communicated between the antenna and the electrical circuit via the first electrode, the plasma, and the second electrode when the plasma is formed, and wherein the communication signals cannot be communicated between the antenna and the electrical circuit via the first electrode and the second electrode when the plasma is not formed.

2. The switching device of claim 1, further comprising at least one bias connector electrically coupled to the first electrode, the second electrode, or both, wherein, when the gas is subjected to an electrical signal between the first electrode and the second electrode that satisfies an electric power level threshold, the gas forms a plasma; and wherein the electric power level threshold is adjustable based on a bias signal applied to the bias connector.

3. The switching device of claim 2, wherein the bias signal is a direct current signal.

4. The switching device of claim 2, wherein the electric power level threshold includes a frequency threshold.

5. The switching device of claim 2, further comprising:

a processor electrically coupled to a memory configured with instructions to adjust the electric power level threshold by applying the bias signal to the bias connector, wherein the bias signal is based on information stored in a database in communication with the processor and the memory, and wherein the database includes information about whether to apply the bias signal, information about a bias signal characteristic or information about a bias signal application timing.

6. The switching device of claim 1, wherein the sealed chamber is defined by a lid and a base, wherein the lid, the base, or both, define a cavity, and wherein the lid is hermetically sealed to the base to enclose the gas.

7. A system comprising:

a radio frequency (RF) circuit;

an antenna; and a first switching device coupled between the RF circuit and the antenna, the first switching device including:

a first electrode at least partially disposed within a first sealed chamber;

a first connector extending external to the first sealed chamber, electrically connected to the first electrode, and configured to electrically couple the first electrode to the RF circuit;

a second electrode coupled to the antenna and at least partially disposed within the first sealed chamber, the second electrode physically separated from the first electrode;

a second connector extending external to the first sealed chamber, electrically connected to the second electrode, and configured to electrically couple the second electrode to the antenna; and a first gas disposed within the first sealed chamber, the first gas configured to form a plasma when subjected to electromagnetic radiation having a particular characteristic, wherein communication signals can be communicated between the antenna and the RF circuit via the first electrode, the plasma, and the second electrode when the plasma is formed, and wherein the communication signals cannot be communicated between the antenna and the RF circuit via the first electrode and the second electrode when the plasma is not formed.

8. The system of claim 7, wherein the RF circuit includes a transmitter circuit and a receiver circuit, wherein the first connector is coupled to the transmitter circuit, the system further comprising:

a second switching device coupled between the RF circuit and the antenna, the second switching device including:

a third electrode at least partially disposed within a second sealed chamber;

a third connector extending external to the second sealed chamber, electrically connected to the third electrode, and configured to electrically couple the third electrode to the receiver circuit;

a fourth electrode at least partially disposed within the second sealed chamber, the fourth electrode physically separated from the third electrode;

a fourth connector extending external to the second sealed chamber, electrically connected to the fourth electrode, and configured to electrically couple the fourth electrode to the antenna; and a second gas disposed within the second sealed chamber, the second gas configured to form a plasma when subjected to electromagnetic radiation having particular characteristics, wherein communication signals can be communicated between the antenna and the receiver circuit via the third electrode, the plasma, and the fourth electrode when the plasma is formed, and wherein the communication signals cannot be communicated between the antenna and the receiver circuit via the third electrode and the fourth electrode when the plasma is not formed.

9. The system of claim 8, wherein, during a receive operation, the plasma is formed in the second switching device and the plasma is not formed in the first switching device.

10. The system of claim 8, wherein, during a transmit operation, the plasma is formed in the first switching device and the plasma is not formed in the second switching device.

11. The system of claim 8, further comprising a substrate, wherein the first switching device and the second switching device are formed in or on the substrate.

12. The system of claim 11, wherein the substrate comprises glass or silicon.

13. The system of claim 8, wherein a bias circuit is coupled to the first switching device by a first bias connector and coupled to the second switching device by a second bias connector, the bias circuit configured to apply a first bias signal to the first switching device to adjust a first electromagnetic threshold and apply a second bias signal to the second switching device to adjust a second electromagnetic threshold, wherein the first electromagnetic threshold for forming plasma of the first switching device is adjustable independently of the second electromagnetic threshold for forming plasma of the second switching device.

14. The system of claim 13, further comprising:

a processor electrically coupled to a memory configured with instructions to adjust the first electromagnetic threshold via the first bias signal and the second electromagnetic threshold via the second bias signal, wherein the first bias signal and the second bias signal are based on information stored in a database in communication with the processor and the memory, and wherein the database includes information about whether to apply the first bias signal and the second bias signal, information about a first bias signal characteristic, information about a second bias signal characteristic, information about a first bias signal application timing for the first bias signal, or information about a second bias signal application timing for the second bias signal.

15. The system of claim 8, wherein the first switching device is separately controllable from the second switching device.

16. The system of claim 7, wherein the RF circuit, the antenna and the first switching device are components of a radar system.

17. The system of claim 7, wherein the antenna includes an antenna array coupled to the second connector, the antenna array including a plurality of antenna elements.

18. A method comprising:

applying a first electromagnetic signal to a first electrode of a first switching device, the first switching device including:

the first electrode at least partially disposed within a first sealed chamber, the first sealed chamber enclosing a quantity of a first gas, wherein the first electrode is coupled to a receiver circuit; and a second electrode at least partially disposed within the first sealed chamber, the second electrode physically separated from the first electrode, wherein the second electrode is coupled to an antenna;

forming a plasma within the first sealed chamber when the first electromagnetic signal satisfies a first power threshold, wherein the first electrode is electrically coupled to the second electrode via the plasma when the plasma is formed, and wherein the first electrode is electrically isolated from the second electrode when the plasma is not formed;

receiving, by the receiver circuit, a signal received by the antenna while the plasma is present in the first sealed chamber;

applying a second electromagnetic signal to a third electrode of a second switching device, the second switching device including:

the third electrode at least partially disposed within a second sealed chamber, the second sealed chamber enclosing a quantity of a second gas, wherein the third electrode is coupled to a transmitter circuit; and a fourth electrode at least partially disposed within the second sealed chamber, the fourth electrode physically separated from the third electrode, wherein the fourth electrode is coupled to the antenna;

forming a plasma within the second sealed chamber when the second electromagnetic signal satisfies a second power threshold, wherein the third electrode is electrically coupled to the fourth electrode via the plasma when the plasma is formed, and wherein the third electrode is electrically isolated from the fourth electrode when the plasma is not formed; and transmitting, by the transmitting circuit, a signal via the antenna while the plasma is present in the second sealed chamber.

19. The method of claim 18, further comprising applying a bias signal to the first electrode, the second electrode, or both, wherein the bias signal changes the first power threshold.

20. The method of claim 19, wherein the bias signal is a direct current signal and the first electromagnetic signal is a radio frequency signal.

* * * * *